US006280022B1

(12) United States Patent
Reinten

(10) Patent No.: US 6,280,022 B1
(45) Date of Patent: Aug. 28, 2001

(54) INK JET NOZZLE HEAD

(75) Inventor: Hans Reinten, Velden (NL)

(73) Assignee: Oce-Technologies B.V., Venlo (NL)

( * ) Notice: Subject to any disclaimer, the term of this patent is extended or adjusted under 35 U.S.C. 154(b) by 0 days.

(21) Appl. No.: 09/235,635

(22) Filed: Jan. 22, 1999

(30) Foreign Application Priority Data

Jan. 23, 1998 (EP) ..... 98200190

(51) Int. Cl.[7] ..... B41J 2/045
(52) U.S. Cl. ..... 347/70; 347/68; 347/71
(58) Field of Search ..... 247/70, 71; 347/68, 347/69

(56) References Cited

U.S. PATENT DOCUMENTS

| | | | | |
|---|---|---|---|---|
| 4,364,070 | | 12/1982 | Matsuda et al. | 346/140 |
| 4,383,264 | * | 5/1983 | Lewis | 346/140 |
| 6,027,207 | * | 2/2000 | Reinten et al. | 347/68 |

FOREIGN PATENT DOCUMENTS

| | | | | |
|---|---|---|---|---|
| A2 0-563603 | | 10/1993 | (EP) . | |
| B1 0-402172 | | 2/1994 | (EP) . | |
| A2 0-713774 | | 5/1996 | (EP) . | |
| 0713774 A2 | * | 5/1996 | (EP) | B41J/2/05 |
| A2 0-718102 | | 6/1996 | (EP) . | |
| A2 0-783965 | | 7/1997 | (EP) . | |
| 0819524A1 | | 1/1998 | (EP) . | |

OTHER PUBLICATIONS

Patent Abstracts of Japan, 09 277527 A, Oct. 28, 1997. (Abstract).
Patent Abstracts of Japan, 09 174836 A, Jul. 8, 1997. (Abstract).
Patent Abstracts of Japan, 09 226104 A, Sep. 2, 1997. (Abstract).

* cited by examiner

*Primary Examiner*—John Barlow
*Assistant Examiner*—An H. Do

(57) ABSTRACT

An ink jet nozzle head including a substrate defining a nozzle and an ink channel connected to the nozzle, a diaphragm covering at least a portion of the ink channel, an actuator capable of deflecting the diaphragm, and a bump arranged for concentrating the force of the actuator that is applied to the diaphragm, wherein the diaphragm has at least two layers, and the bump forms a spacer for separating these two layers.

8 Claims, 3 Drawing Sheets

INK JET NOZZLE HEAD

BACKGROUND OF THE INVENTION

The present invention relates to an ink jet nozzle head comprising means defining a nozzle and an ink channel connected to said nozzle, a diaphragm covering at least a portion of said ink channel, actuator means capable of deflecting the diaphragm, and bump means arranged for concentrating the force of the actuator means that is applied to the diaphragm. The present invention also relates to methods of manufacturing the nozzle head and, in particular, the diaphragm thereof.

A nozzle head of the present type is used for the generation of ink droplets in an ink jet printer. When a signal is applied to the actuator means, this causes the actuator means to deflect the diaphragm so that the volume of liquid ink contained in the ink channel is pressurized and deflected, and an ink droplet is expelled from the nozzle.

EP-A-0 718 102 discloses a nozzle head of this type in which the actuator means are formed by an elastic plate which is arranged in parallel with the diaphragm and spaced apart therefrom by a predetermined distance. An electrode is provided on a surface of the elastic plate for locally heating the same so that thermal stresses are created which cause the elastic plate to buckle. A connecting member or bump is disposed substantially in the central part of the elastic plate and mechanically connects the same to the diaphragm so that, when the plate buckles, the diaphragm is deflected accordingly.

In another known type of ink jet nozzle head which is disclosed, for example, in EP-A-0 402 172, the actuator means are formed by a piezoelectric finger which engages the diaphragm with its end face. A plurality of ink channels and nozzles respectively associated therewith are formed in the surface of a channel plate which is covered by the diaphragm. A separate piezoelectric actuator is provided for each of the ink channels. Thus, a multiple-nozzle head is formed in which the nozzles are arranged in a linear array and can be operated independently, so that a higher printing speed and/or image resolution can be achieved.

In order to increase the image resolution, it is desirable to make the pitch between the nozzles as small as possible. This means, however, that the associated ink channels must be comparatively narrow. When the width of the ink channels is decreased, the thickness of the diaphragm must be decreased as well in order to assure a sufficient flexibility of the diaphragm. In a practical print head in which the width of each ink channel is in the order of 300 $\mu$m, the thickness of the diaphragm which may for example be formed by a thin glass plate should ideally be smaller than 30 $\mu$m. However, such a thin diaphragm is difficult to manufacture and to handle.

In applicant's co-pending European patent application No. 96 202 043 it has been proposed to provide bumps on the surface of the diaphragm so that each piezoelectric actuator is connected with the diaphragm only in the limited area of a single bump which is considerably narrower than the piezoelectric finger. This increases the distance over which the diaphragm is allowed to flex, so that the flexibility of the diaphragm will be sufficient even when the thickness thereof is made larger.

The bumps can be formed for example by appropriately etching the surface of a glass plate which originally has a uniform thickness.

The problem encountered in this approach is that the surface area in which the piezoelectric finger is in contact with the diaphragm becomes very small. It should be observed in this context that the actuator should be firmly bonded to the diaphragm in order for the actuator to be capable of performing not only compression strokes but also suction strokes in which ink liquid is drawn into the ink channel. The smaller the contact area becomes the more difficult it is to firmly bond the actuator to the bump.

In addition, if the height of the bump is comparatively small, e.g. in the order of only 1 $\mu$m, the cavities formed on either side of the bump are likely to become clogged with adhesive, with the result that the force of the actuator is no longer concentrated on the area of the bump but is partly transmitted also via the adhesive on either side thereof, so that the effect of the bump is diminished or completely eliminated. Similar problems are encountered when the shallow grooves between the bumps are soiled with dust particles or the like or when the surface of the piezoelectric actuator itself is rather rough, due to the granular structure of the piezoelectric material.

In order to avoid problems of this kind, the height of the bumps should be increased to at least about 5 $\mu$m. This, however, makes the etching process time consuming and expensive. In addition, when an amorphous material such as glass is used for the diaphragm, the etching process is isotropic and, hence, the formation of sufficiently high but narrow bumps is difficult to control.

SUMMARY OF THE INVENTION

It is an object of the present invention to provide an ink jet nozzle head which, in spite of a small width of the ink channel, can be manufactured easily and reliably and with reproducible characteristics.

According to the present invention, the diaphragm has at least two layers, and the bump means forms a spacer which is disposed between these two layers. This solution has the advantage that the diaphragm has a smooth and continuous outer surface and accordingly provides a sufficiently large bonding surface for firmly bonding the diaphragm to the actuator. Nevertheless, the force of the actuator is concentrated by the bump so that the inner layer of the diaphragm facing the ink channel is allowed to flex over the whole length between the bump and the lateral edge of the ink channel. Moreover, the cavities formed on either side of the bump are completely enclosed between the two layers of the diaphragm. This eliminates the risk that these cavities can become clogged with adhesive or other foreign matter. As a result the height of the bumps or, conversely, the depth of the grooves between them, can be reduced considerably, which drastically increases the production efficiency.

When the diaphragm is deflected, the two layers thereof behave substantially like two separate diaphragms, because they are spaced apart by the bumps and, accordingly, there is no friction between the two layers. Thus, the stiffness of the diaphragm as a whole is approximately equal to only twice the stiffness of a single layer. In comparison, the stiffness of a diaphragm consisting only of a single layer with twice this thickness would be four times as large, because the bending stiffness of a plate is approximately equal to the third power of the thickness. Thus, the thickness of the two layers of the diaphragm according to the present invention can be allowed to be so large that it will impose no serious manufacturing problems.

Once a channel plate has been prepared and the ink channels have been formed in the surface thereof, a glass plate which is to form the inner layer of the diaphragm and the bumps is superposed on the channel plate so as to cover the open faces of the ink channels. If the channel plate itself is made of glass, the superimposed glass plate may be compression bonded to the channel plate, so that an integral member is formed. Selected portions of the outer surface of the superposed glass plate are then etched away so that only the bumps are left in the form of elongate ridges extending along the center lines of the ink channels. Since the glass plate is already fixedly connected to the channel plate in this state, the bumps can be positioned precisely relative to the ink channels. Then, a second glass plate forming the outer layer of the diaphragm is superimposed on the bumps and is fixed thereto by compression bonding.

Since the diaphragm is thus integrally connected with the channel plate, it can be handled easily and safely in the subsequent mounting steps, and, in particular, there is no risk that the gaps between the bumps can be terminated.

The process described above can be performed with comparatively large wafers which are then diced to form a plurality of integrated channel plate/diaphragm units for a plurality of nozzle heads.

BRIEF DESCRIPTION OF THE DRAWINGS

Preferred embodiments of the present invention will now be described in conjunction with the accompanying drawings, wherein.

DETAILED DESCRIPTION OF THE INVENTION

Figure 1:
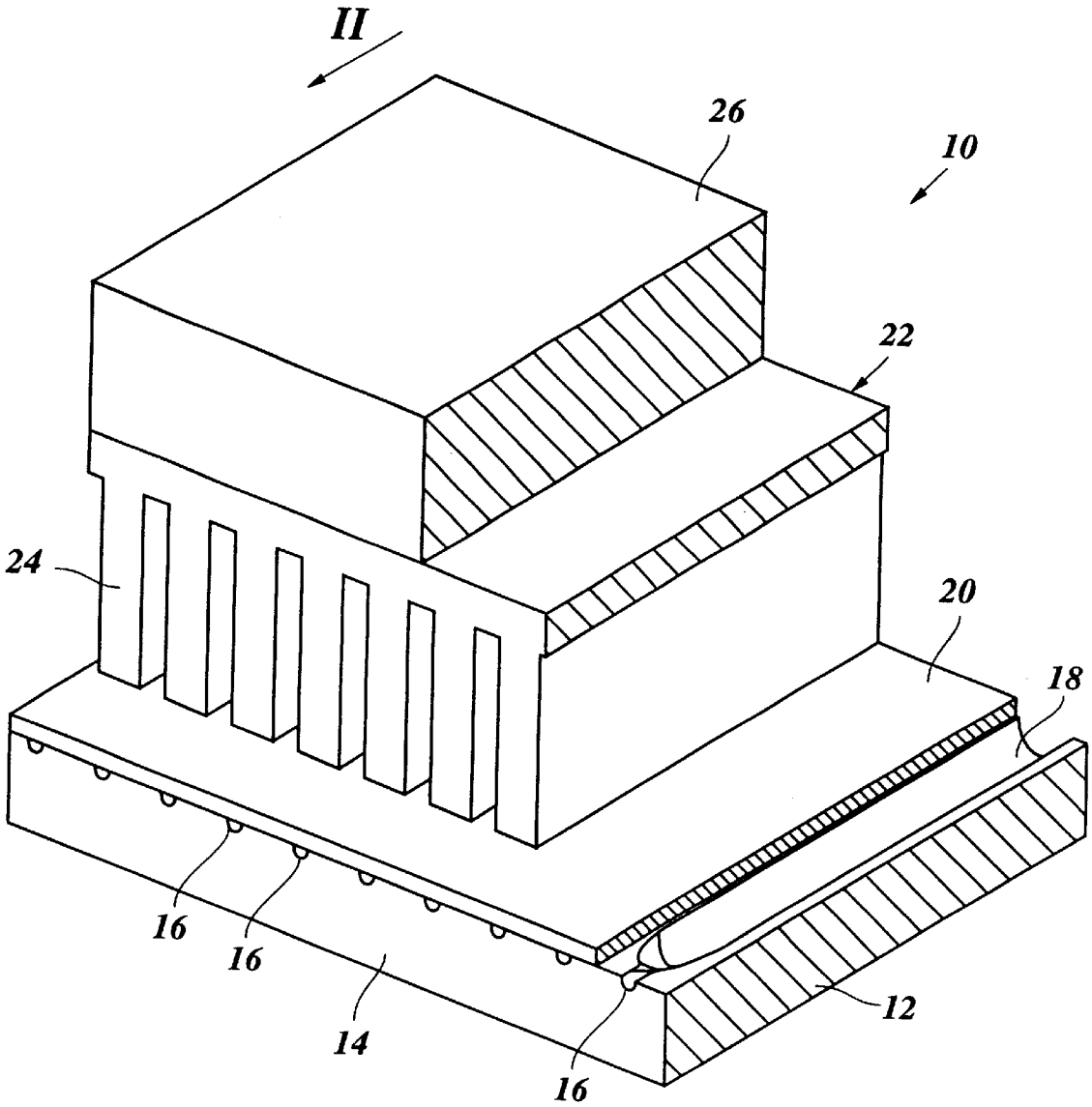
FIG. 1 is a perspective view of a portion of a nozzle head with parts broken away for illustration purposes.

As is shown in FIG. 1, an ink jet nozzle head 10 comprises a channel plate 12 which has a front face 14 formed with a linear array of equidistant nozzles 16. A plurality of ink channels 18 are formed in the top surface of the channel plate 12. These ink channels are arranged in parallel to one another and are connected to corresponding nozzles 16.

A diaphragm 20 is bonded to the top surface of the channel plate 12 so as to cover the open faces of the ink channels 18 and the nozzles 16.

An actuator member 22 is superimposed on the diaphragm 20 and forms a plurality of piezoelectric actuators 24 which are configured as parallel, downwardly extending fingers, the lower end faces of which being bonded to the diaphragm 20. Each actuator 24 is opposed to one of the ink channels 18.

A backing plate 26 is overlaid on the top side of the actuator member 22 and is bonded thereto for absorbing reaction forces caused by the expansion and retraction strokes of the individual actuators 24.

Figure 2:
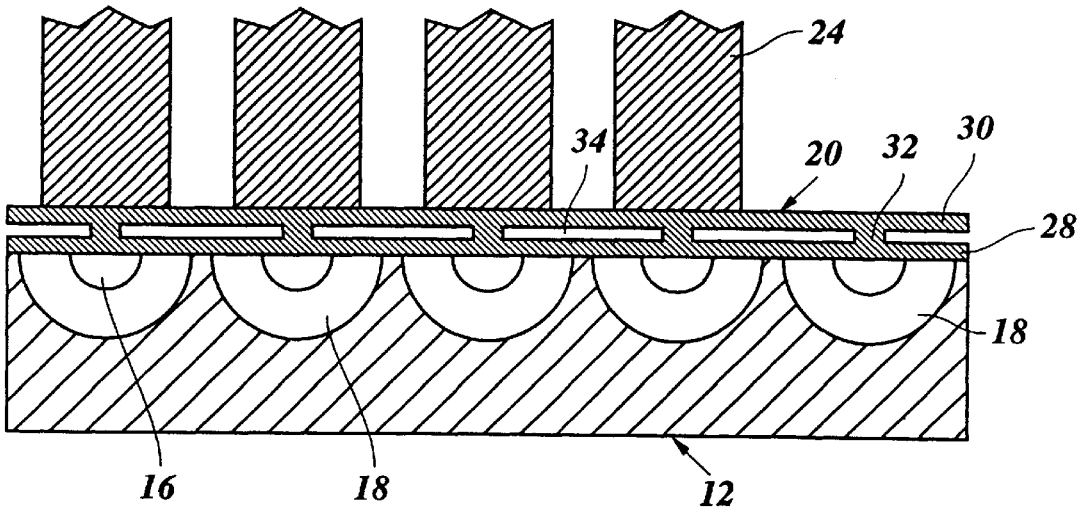
FIG. 2 is an enlarged cross-sectional view of the nozzle head according to FIG. 1 as viewed in the direction of arrow 11 in FIG. 1.

As is shown in FIG. 2, the diaphragm 20 is an integral, layered structure with a lower layer or inner layer 28 facing the ink channels 18 and a top layer or outer layer 30 connected to the actuators 24. The two layers 28 and 30 are interconnected and at the same time held in a spaced-apart relationship by a plurality of elongated bumps 32 which are centered on the ink channels 18. The width of the actuators 24 is only slightly smaller than the width of the ink channels 18, whereas the width of the bumps 32 is considerably smaller than that of the actuators.

The separation between the layers 28 and 30 is exaggerated in the drawing. In practice, the distance between these layers and hence the height of cavities 34 enclosed by the layers 28, 30 and the bumps 32 may amount to only 1 or 2 $\mu$m.

Figure 3:
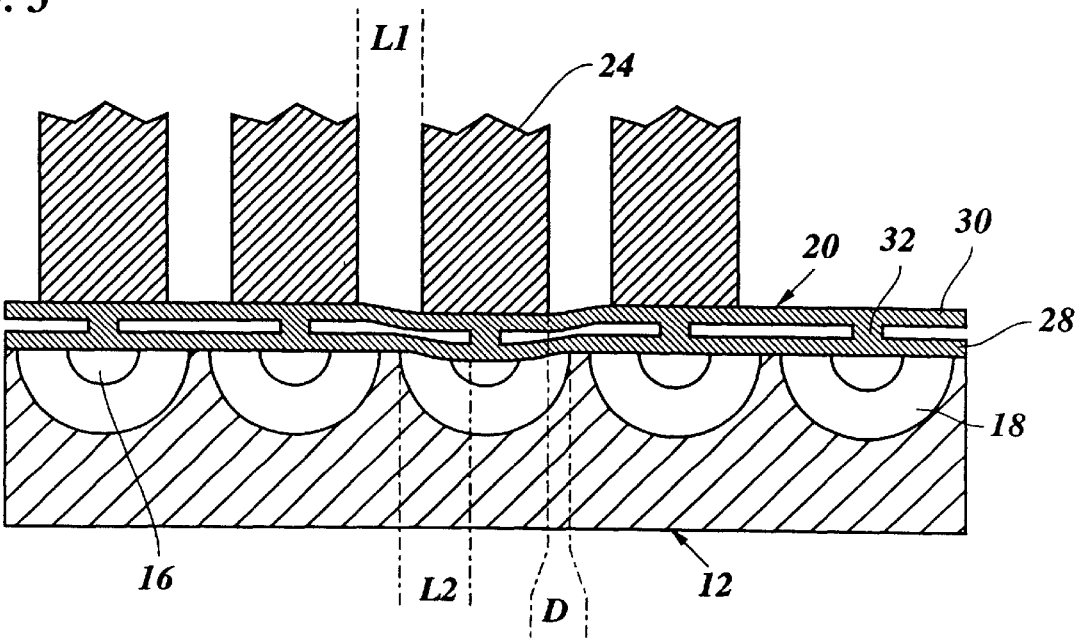
FIG. 3 is a cross-sectional view corresponding to FIG. 2, but showing an active state of the nozzle head.

FIG. 3 illustrates how the diaphragm 20 is deflected when one of the actuators 24 performs a compression stroke. The length of the stroke of the actuator is also exaggerated in the drawing and amounts to less than 0.1 $\mu$m in a practical embodiment. It will be observed that the outer layer 30 is allowed to flex over a distance L1 which corresponds to the width of the gap between two adjacent actuators 24, whereas the inner layer 28 is allowed to flex over a length L2 which corresponds to the distance between the bump 32 and the edge of the ink channel 18. Both lengths L1 and L2 are considerably larger than the distance D between the edge of the actuator 24 and the edge of the ink channel 18. Thus, even when the thickness of each of the layers 28 and 30 is 30 $\mu$m or larger, the stiffness of the diaphragm 20 as a whole is small enough for efficiently transferring the mechanical energy of the actuator 24 to the ink volume in the channel 18.

The cavities 34 between the layers 28 and 30 are slightly compressed when the diaphragm is deflected, but as the stroke length is small in comparison to the height of the cavities. Thus the layers 28 and 30 will never contact each other.

A manufacturing process for the nozzle head described above will now be explained with reference to FIGS. 4 to 7.

Figure 4:
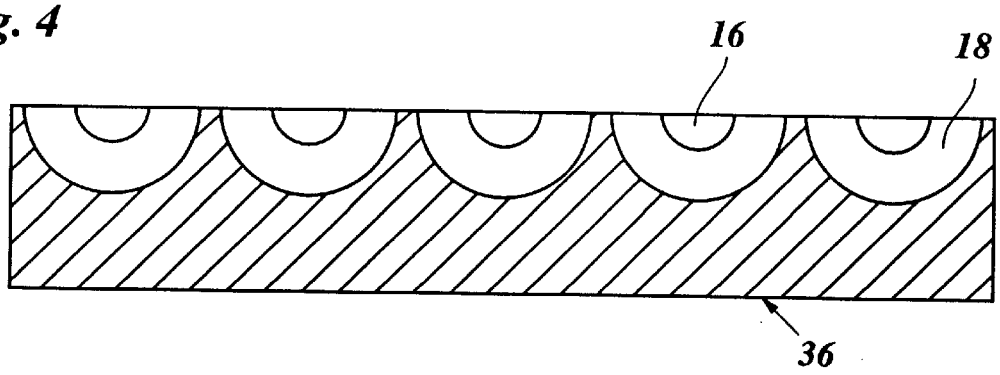
FIGS. 4 to 7 are cross-sectional views illustrating steps of a manufacturing process for the nozzle head.
Figure 5:
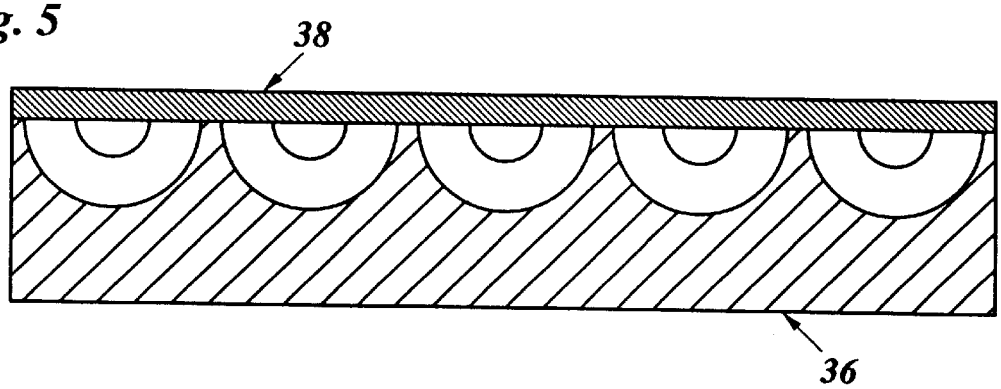

FIG. 4 shows a portion of a wafer 36 from which a number of channel plates 12 are to be formed. The ink channels 18 and the nozzles 16 are formed in a top surface of the wafer 36. Then, as is shown in FIG. 5, a glass plate 38 is disposed on the top surface of the wafer 36 and is bonded thereto. If the substrate 36 is also made of glass, the bonding may be achieved without adhesive, by compression bonding or thermocompression bonding. The thickness of the glass plate 38 corresponds to that of the lower layer 28 of the diaphragm plus the height of the bumps 32.

Figure 6:
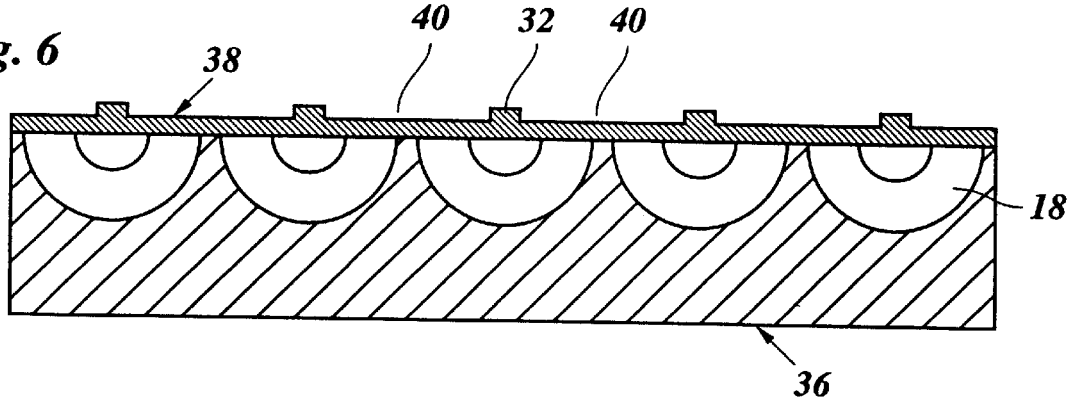

As is illustrated in FIG. 6, a pattern of parallel grooves 40 is formed in the top surface of the glass plate 38, for example by means of conventional etching techniques. The material left between the grooves 40 forms the bumps 32. Since the ink channels 18 are visible through the transparent glass plate 38, the masking for the etching process can be applied appropriately in order to center the bumps 32 on the ink channels.

Figure 7:
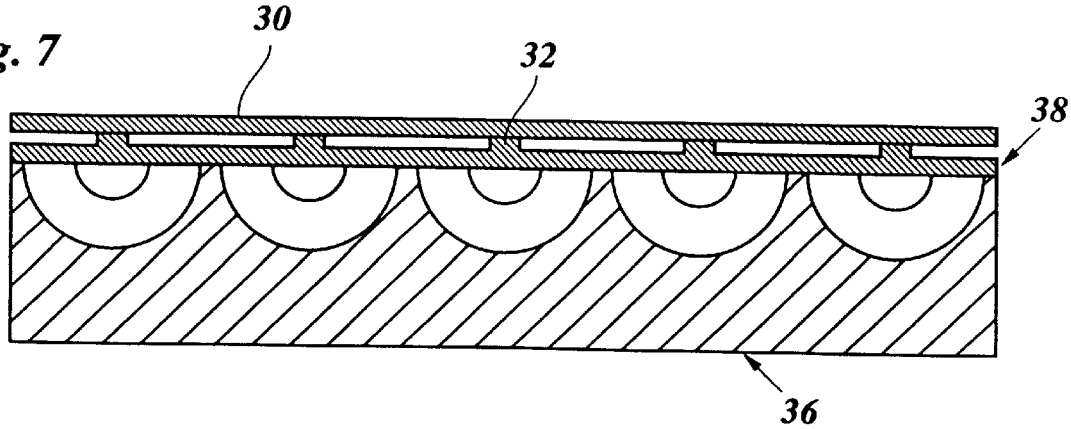

Finally, as is illustrated in FIG. 7, another thin glass plate which is to form the outer layer 30 is superimposed on the bumps 32 and is bonded thereto by compression bonding or thermocompression bonding, thereby forming the integral structure of the diaphragm 20.

The wafer 36 with the diaphragm 20 formed thereon is then diced to form a plurality of integral channel plate/diaphragm units for a plurality of nozzle heads 10. The lower end faces of the actuators 24 of the actuator member 22 are bonded to the top surface of the diaphragm 22 by means of an adhesive.

Since the layered structure of the diaphragm 20 comprising the two layers 28 and 30 and the bumps 32 disposed therebetween has a comparatively high inherent strength, the diaphragm 20 can be handled relatively safely as a separate member, so that it is also possible to manufacture the diaphragm separately and then bond it to the channel plate 12 by means of an adhesive or another suitable bonding technique. The diaphragm 20 can also be made from other materials such as a metal or even a plastic.

It is clear that to maintain the cleanliness of the cavities 34 the diaphragm 20 is closed on all sides.

While only specific embodiments of the present invention have been described above, it will occur to a person skilled in the art that the invention can be modified in various ways without departing from the spirit and scope of the invention as defined in the appended claims.

What is claimed is:

1. An ink jet nozzle head comprising:

a substrate means defining at least one nozzle and ink channel connected to said nozzle, a diaphragm covering at least a portion of said ink channel, actuator means for generating a force capable of deflecting the diaphragm, and bump means arranged for concentrating the force of the actuator means to be applied to the diaphragm, wherein the diaphragm has at least two layers, and the bump means is formed as a spacer disposed between these two layers.

2. The ink jet nozzle head according to claim 1, wherein said substrate means is a channel plate which defines a plurality of ink channels and associated nozzles which are formed in parallel in a surface of said channel plate, and the diaphragm extends over said plurality of ink channels.

3. The ink jet nozzle head according to claim 1, wherein the actuator means are formed by piezoelectric actuators which are aligned with the respective ink channels and each of the piezoelectric actuators has an end face bonded to the surface of the diaphragm.

4. The ink jet nozzle head according to claim 1, wherein the diaphragm is an integral structure made of glass.

5. The ink jet nozzle head of claim 1, wherein the actuator means has a width which is slightly smaller than the width of the ink channels and the width of the bumps is substantially smaller than the width of the actuators.

6. The ink jet nozzle head of claim 1, wherein the diaphragm has an outer layer and an inner layer relative to the ink channel, said outer layer flexing over a distance which corresponds to the width of a gap between adjacent actuators and said inner layer flexing over a length corresponding to the distance between the bump means and an edge of the ink channel.

7. The ink jet nozzle head of claim 6, wherein the amount of flex of the outer and inner layers is substantially larger than the distance between the edge of the actuators and the edge of the ink channels.

8. The ink jet nozzle head of claim 1, wherein the bump means are positioned below the actuators and centered on said actuators.

* * * * *